US005286244A

United States Patent [19]

Wright et al.

[11] Patent Number: 5,286,244

[45] Date of Patent: Feb. 15, 1994

[54] MULTI-FUNCTIONAL HAND WEIGHT

[75] Inventors: Donna J. Wright, West Bloomfield; William J. Gallup, Bloomfield Hills, both of Mich.

[73] Assignee: Safety Sports, Ltd., Mich.

[21] Appl. No.: 817,307

[22] Filed: Jan. 6, 1992

[51] Int. Cl.[5] ..... A63B 21/075; A63B 71/00

[52] U.S. Cl. ..... 482/108; 482/74; 482/3; 116/202

[58] Field of Search ..... 482/106, 107, 108, 109, 482/74, 1, 3, 5, 8, 81, 82; 128/26, 774, 782; 340/323 R, 32 C, 573, 574; 116/202

[56] References Cited

U.S. PATENT DOCUMENTS

| | | | |
|---|---|---|---|
| 273,030 | 3/1884 | Anderson . | |
| 734,062 | 7/1903 | Harris . | |
| 742,393 | 10/1903 | McAnanny . | |
| 1,215,389 | 2/1917 | Lauray . | |
| 1,511,312 | 10/1924 | Alastalo . | |
| 1,581,235 | 4/1926 | Sorel . | |
| 1,672,944 | 6/1928 | Jowett . | |
| 1,917,566 | 7/1933 | Wood . | |
| 1,991,520 | 2/1935 | Postl . | |
| 2,139,281 | 12/1938 | Oliveri . | |
| 2,509,810 | 5/1950 | Core, Jr. . | |
| 2,617,650 | 11/1952 | Landis . | |
| 2,632,093 | 3/1953 | Merolis et al. . | |
| 2,952,459 | 9/1960 | Moffitt . | |
| 2,962,580 | 11/1960 | Jones . | |
| 3,109,653 | 11/1963 | Biggs . | |
| 3,227,455 | 1/1966 | Hulsman . | |
| 3,248,723 | 4/1966 | Miethe | 340/573 |
| 3,322,425 | 5/1967 | Moore . | |
| 3,565,451 | 2/1971 | Giambazi . | |
| 3,734,493 | 5/1973 | Hasekian . | |
| 3,737,647 | 6/1973 | Gomi . | |
| 3,836,824 | 9/1974 | Watrous . | |
| 3,880,443 | 4/1975 | Tobin . | |
| 3,894,225 | 7/1975 | Chao . | |
| 3,944,803 | 3/1976 | Chao . | |
| 4,029,312 | 6/1977 | Wright . | |
| 4,034,494 | 7/1977 | Lane . | |
| 4,055,014 | 10/1977 | Schmidt et al. . | |
| 4,105,200 | 8/1978 | Unger . | |
| 4,109,908 | 8/1978 | Pugh et al. . | |
| 4,164,008 | 8/1979 | Miller et al. . | |
| 4,192,000 | 3/1980 | Lipsey | 482/8 X |
| 4,218,057 | 8/1980 | Wilson . | |
| 4,283,797 | 8/1981 | Seider . | |
| 4,286,399 | 9/1981 | Funahashi et al. . | |
| 4,308,572 | 12/1981 | Davidson et al. . | |
| 4,320,767 | 3/1982 | Villa-Real | 128/782 X |
| 4,351,526 | 9/1982 | Schwartz . | |
| 4,466,136 | 8/1984 | Bottom et al. . | |
| 4,480,293 | 10/1984 | Wells . | |
| 4,557,275 | 12/1985 | Dempsey, Jr. | 128/782 |
| 4,566,690 | 1/1986 | Schook . | |
| 4,570,206 | 2/1986 | Deutsch . | |
| 4,575,074 | 3/1986 | Damratoski . | |
| 4,599,682 | 7/1986 | Stephens . | |
| 4,602,191 | 7/1986 | Davila . | |
| 4,621,808 | 11/1986 | Orchard et al. . | |

(List continued on next page.)

FOREIGN PATENT DOCUMENTS

| | | | |
|---|---|---|---|
| 2276069 | 1/1976 | France | 482/82 |

*Primary Examiner*—Richard J. Apley
*Assistant Examiner*—John P. Leubecker
*Attorney, Agent, or Firm*—Brooks & Kushman

[57] ABSTRACT

A multi-functional hand Weight for use by runners having a weighted body with a first end portion and a second end portion and a hand grip portion. The hand weight has sufficient weight for enhancing exercise. A signal means is provided for emitting either a light or sound signal. Switches are provided for controlling the light and the alarm. A battery selectively provides power to the light and alarm. A motion detection switch indicates a vertical orientation of the hand-weight by emitting light through the light transmitting first end portion and indicating a horizontal orientation by not emitting light through the first end portion.

10 Claims, 2 Drawing Sheets

U.S. PATENT DOCUMENTS 4,627,618 12/1986 Schwartz .
4,690,399 9/1987 Hayashi .
4,702,473 10/1987 Paquette .
4,709,307 11/1987 Branom .
4,720,098 1/1988 Gordon .
4,768,780 9/1988 Hayes .
4,770,409 9/1988 Walloch .
4,787,624 11/1988 Grant .
4,801,137 1/1989 Douglass .
4,809,974 3/1989 Buhr .
4,813,669 3/1989 Caruthers .
4,823,240 4/1989 Shenker .
4,850,079 7/1989 Thompson .
4,867,444 9/1989 Castillo .
4,880,228 11/1989 Caruthers .
4,882,865 11/1989 Andeweg .
4,896,880 1/1990 Caruthers .
4,900,016 2/1990 Caruthers .
4,943,047 7/1990 Noble ..... 482/8 X
4,959,637 9/1990 Woods et al. ..... 340/573
5,075,671 12/1991 Livingston, III ..... 340/574
5,089,808 2/1992 Amirdash ..... 340/573
5,135,454 8/1992 Yeh ..... 482/108

MULTI-FUNCTIONAL HAND WEIGHT

TECHNICAL FIELD

This invention relates to hand weights, and in particular, to hand weights having a signalling means for emitting a light and an audible sound.

BACKGROUND ART

Hand weights or arm exercisers are used by joggers to provide more effective use of workout time by exercising the hands, wrist, and arms while running or jogging. Proper use of the hand weights is essential to a proper workout. The inclusion of a biofeedback mechanism incorporated into the hand weight improves the effectiveness of any such workout.

U.S. Pat. Nos. 4,351,526; and 4,627,618 issued to Schwartz disclose aerobic hand weights having a hollow enclosure portion for carrying electronic circuitry for use in connection with exercising. Electronic circuitry may possibly be utilized with a timing device, a work load calculator, a stress-measuring apparatus, or the like. However, these configurations only provide numerical measurements during exercise and do not provide instant biofeedback which enables the user to maintain proper form or technique of the related arm movement to ensure a proper workout.

Running or jogging during hours when natural lighting is limited has become more common because of weather conditions and/or time constraints. As a result, it is necessary for improved safety that runners carry external light signals to improve their visibility to motorists and others. In addition, it is common for runners to carry whistles, air horns, or similar items to ward off potential danger as well as to attract attention if in peril.

Hand weights are produced with varying configurations. One configuration includes a wrist strap as disclosed in U.S. Pat. No. 4,218,057 to Wilson. The Wilson patent does not include either an alarm or a light to provide a measure of safety for the user. The wrist strap is provided merely as a means of preventing the user from dropping the hand weight should it slip from one's hand.

Another example of a hand weight design is disclosed in U.S. Pat. No. 4,702,473 to Paquette which proposed combining the hand weight with a liquid container to enable the runner to obtain a drink from the hand weight. The Paquette device is essentially a D-shaped combination hand weight and water dispenser having a straight portion for gripping, and a hollow arcuate portion for water storage. The device includes a U-shaped reflector mounted on the arcuate portion. The Paquette patent utilizes a reflector as a safety feature. However, a reflector is effective only in a limited number of positions.

The prior art fails to provide runners or joggers with hand weights which serve a dual purpose of improving the safety of running during hours of limited lighting by providing an intermittent light for visibility and an alarm for warding off danger or attracting attention if in distress. Secondly, the prior art fails to disclose the concept of providing an intermittent light responsive to movement of the hand weight for providing immediate biofeedback. The intermittent light, in response to movement, signals the user to ensure a proper use of the hand weight for an effective workout.

The present invention is directed to overcoming one or more of the problems set forth above.

DISCLOSURE OF INVENTION

An object of the present invention is to provide a hand weight capable of emitting both light and sound for the safety of the user.

Another object of the present invention is to provide a hand weight utilizing an intermittent light for the purposes of providing a runner with biofeedback in response to the orientation of the hand weight.

A further object of the present invention is to provide a hand weight utilizing an intermittent light for the purpose of increasing battery life.

To obtain the above objects of the present invention, a multi-functional hand weight is provided having a body with a first end portion and a second end portion, and a hand grip portion such that the body has sufficient weight to enhance exercise during use of the hand weight. A signal means is provided for emitting a perceptible signal. A power supply means is provided to provide power to the signal means. A switch means is provided for enabling the power supply means to supply power to the signal means in response to repetitive movement of the runner while running resulting in the power being supplied to the signal means intermittently.

Another object of the present invention is to provide a multi-functional hand weight for a runner having a body with a first end portion, a second end portion, and a hand grip portion such that the body has sufficient weight to enhance exercise during use of the hand weight. A light means is provided in the first portion to emit light. An alarm means is provided in the second portion for emitting an audible sound. A power supply means provides power to the light means and the alarm means. A switch means selectively controls the power to the light means and the alarm means.

A further object of the present invention is to provide a multi-functional hand weight for runners having a body with a lens end, an alarm end, and a hand grip portion such that the body has sufficient weight to enhance exercise during use. A first switch is located in the hand grip portion and has a motion detection switch connected in series to alternatively open and close an electrical circuit in response to different orientations of the hand weight resulting from repetitive movement during use. A light is located in the lens end for emitting an intermittent light in response to activation of the first switch. A second switch is located in the hand grip portion. An alarm is located in the alarm end for emitting an audible sound in response to activation of the second switch. A power supply is located within the hand grip portion to supply power to the light and to the alarm.

The above objects, features, and advantages of the present invention are readily apparent from the following detailed description of the best mode for carrying out the invention when taken in connection with the accompanying drawings.

BEST MODE FOR CARRYING OUT THE INVENTION

Figure 1:
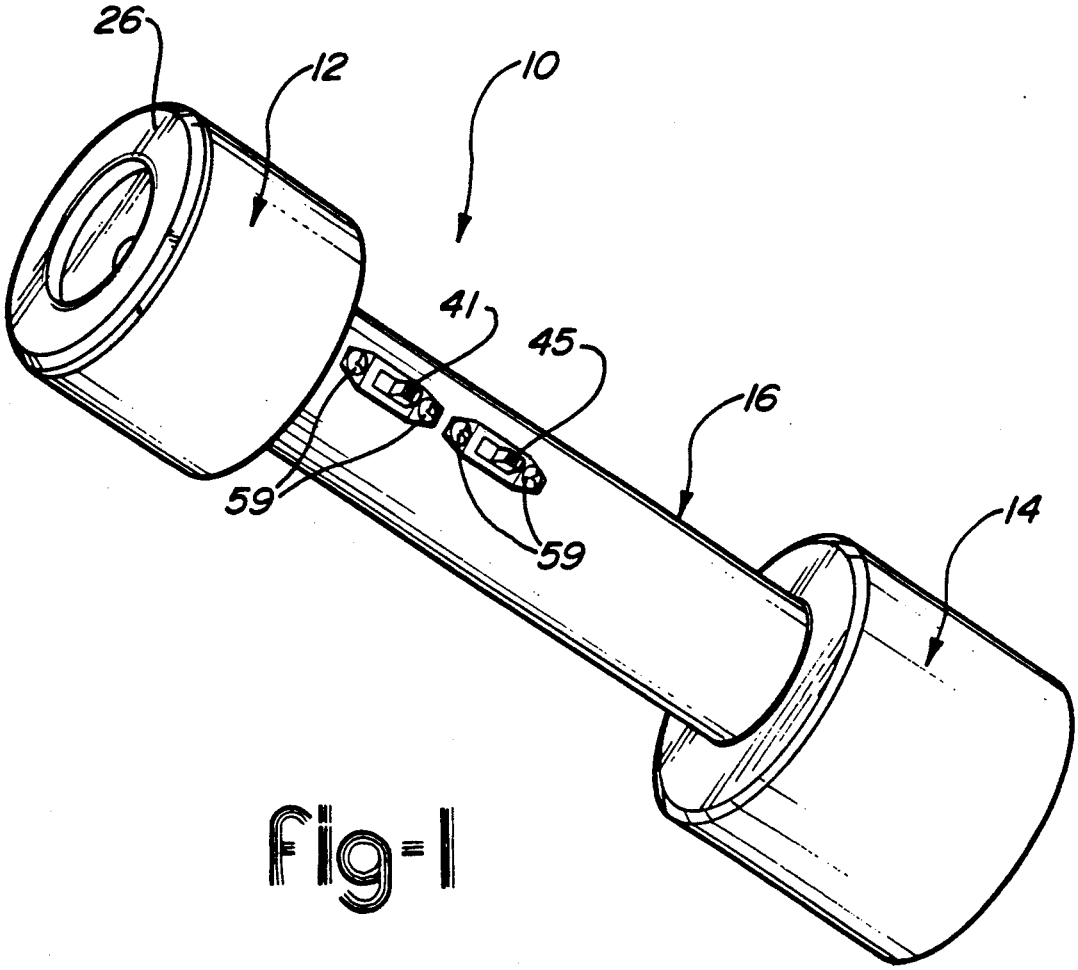
FIG. 1 is a perspective view of the hand weight in accordance with the present invention.

Referring to FIG. 1, a multi-functional hand weight is generally indicated at 10. The hand weight 10 has a first end portion and a second end portion, indicated at 12 and 14, respectively. A hand grip portion 16 is adapted to be gripped by a hand and is located between the first end portion 12 and the second end portion 14.

The hand grip portion 16 has male threaded ends 18 and 20 located at each opposite end. These male threaded ends 18 and 20 cooperate with female threaded ends 22 and 24 located inside the first end portion 12 and the second end portion 14 to removably fasten the first end portion 12 and the second end portion 14 to the hand grip portion 16.

The first end portion 12 has a generally cylindrical shape and is made of a light transmitting material. An end piece 26 is red in color and a body piece 28 is clear such that both the end piece 26 and the body piece 28 are able to transmit light. A first cavity 30 is formed within the body piece 28 for receiving the male threaded end 18 of the body 16. The first cavity 30 is relatively smaller in diameter than the female threaded end 22. A shoulder 32 is formed between the female threaded end 22 and the first cavity 30. The first cavity is sized to receive a light bulb 34.

Figure 3:
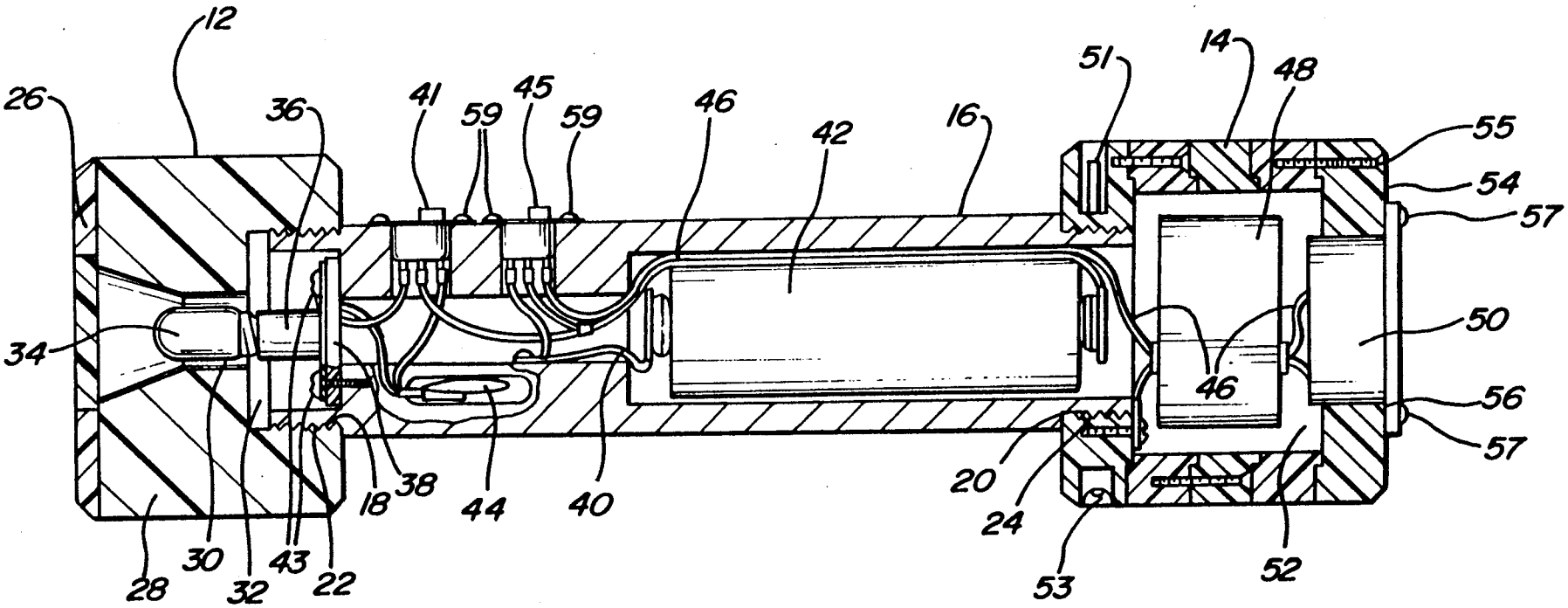
FIG. 3 is a cross-sectional view of the device shown in FIG. 1 illustrating the internal components in accordance with the present invention.

As shown in FIG. 3, the body 16 is generally a hollow cylindrical shape having a receptacle or socket 36 located at male threaded end 18 to receive the light bulb 34. A platform 38 is located near the male threaded end 18 to support the socket 36. A conventional first wiring harness 40 is attached to the socket 36. The first wiring harness 40 provides an electrical connection between the light bulb 34, the socket 36, a first switch element 41, and a power supply 42. A plurality of screws 43 secure the platform 38 to the body 16 and assist in connecting the first wiring harness 40 to the socket 36. The first wiring harness 40 connects a motion detection switch 44 (in this embodiment a mercury switch produced by Honeywell—part number AS412A2) to the first switch element 41 incorporating the motion detection switch 44 into the electrical circuit. The motion detection switch 44 provides an intermittent opening and closing of the electrical circuit in response to a change in the orientation of the hand weight 10 caused by movement during use by a runner. The motion detection switch 44 is activated by the first switch element 41 being moved to an on position.

The power supply 42 is located near the male threaded end 20 an consists of the opposite end of the first wiring harness 40 and a 12 volt battery or the like commonly sold by Duracell®. A second wiring harness 46 connects the power supply 42 to a second switch element 45, a sound amplifier 48, and an alarm 50. The power supply 42 may include a charging port 51 for recharging the battery and a light emitting diode 53 or similar indicator light. The charging port 51 and light emitting diode 53 are located within the second end portion 14 and co-operate with the power supply 42 to indicate when the power supply is sufficiently charged to enable use of the device.

Figure 2:
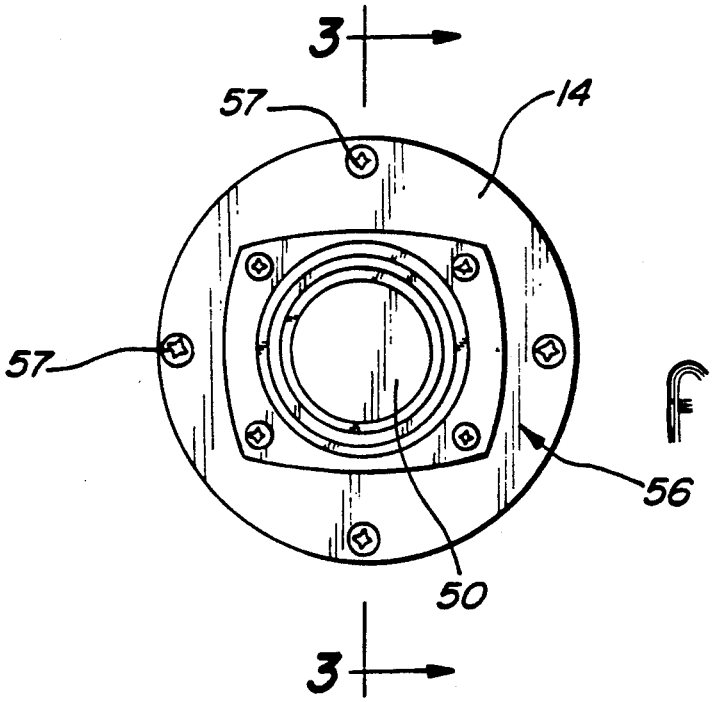
FIG. 2 is an end view of the device shown in FIG. 1.

The second end portion 14 has a second cavity 52 which is relatively larger than the female threaded end 24. The sound amplifier 48 is located within the second cavity 52. FIGS. 2 and 3 show an end cap 54 affixed to the second end portion 14 opposite the female threaded end 24 by screws 55. An aperture 56 is centrally located in the end cap 54 for receiving the alarm 50. The alarm 50 is fastened to the end cap 54 by screws 57. The alarm 50 is electrically connected to the sound amplifier 48 and the power supply 42 and the second switch element 45 by means of the second wiring harness 46.

The first switch element 41 and the second switch element 45 are located within the body 16 such that they may be individually activated by being moved to either an on position or an off position. The first switch element 41 and the second switch element 45 are fastened to the body 16 by screws 59.

In operation, the user carries the hand weight 10 in either hand (a second hand weight 10' having all or some of the elements described above may be utilized in the other hand for balance and an equal workout by both arms). When running in light conditions which makes lighting a proper safety concern, or when desired, the first switch element 41 is moved to the on position thereby activating the light bulb 34.

The activation of the first switch element 41 results in power being supplied from the power supply 42 to the motion detection switch 44 intermittently, in response to the orientation of the hand weight 10. Specifically, when the hand weight 10 is in a horizontal orientation, the electrical circuit is open because the motion detection switch 44 has not completed the circuit. When the hand weight 10 is in a vertical orientation the motion detection switch 44 completes the circuit thereby allowing power to be supplied to the light bulb 34 which then emits light. The result is that the runner is provided with biofeedback because the circuit is only completed when the hand weight 10 is in the vertical position. Thus, the runner is encouraged to perform a complete motion of the arms moving the hand weight from the horizontal orientation through to the vertical orientation during exercise. The result is improved exercise by increased movement of the hand weight. The intermittent flashing of the light bulb 34 in response to orientation of the hand weight 10 has the further advantage of prolonging life of the power supply 42.

An alternative embodiment of the present invention may include a timer switch 60 rather than a motion detection switch 44 which enables the light bulb 34 to blink intermittently at a predetermined interval. This embodiment would remove the biofeedback element of the device. Alternatively, the timed switch could be variable to be used as a pace setting device. A runner could set the light blinking frequency to a desired number of cycles per minute and then match arm movement and running pace to the light.

The alarm 50 may be activated independently of the light bulb 34 by movement of the second switch element 45 from the off position to the on position. The result is that the power supply 42 provides power to the alarm 50. The sound amplifier 48 amplifies the sound emitted from the alarm 50 so that a loud high pitched sound is emitted to call attention to the user in case of emergency as well as to ward off potential danger. It is preferred that when the alarm 50 is activated that the light bulb 34 is also on to allow visual signalling.

While the best mode for carrying out the invention has been described in detail, those familiar with the art to which this invention relates will recognize various alternative designs and embodiments for practicing the invention as defined by the following claims.

What is claimed is:

1. A handweight for runners, the hand weight comprising:

a body having a first end portion, a second end portion, said first end portion being made in substantial part from a light transmitting material and a hand grip portion;

a signal means for emitting a perceptible signal, said signal means including a light in said first end portion and an electrical circuit operably connected to said light;

power supply means for enabling said power supply means to supply power to said signal means; and means for providing biofeedback to a runner, wherein said biofeedback means includes a motion detection switch for indicating a vertical orientation of said body by closing said electrical circuit and for indicating a non-vertical orientation of said body by opening said electrical circuit in response to a repetitive movement of a runner while running to cause the power to be supplied to said signal means intermittently.

2. The hand weight of claim 1 wherein said signal means further includes an alarm in said second end portion and operably connected to said power supply.

3. The hand weight of claim 2 further including a switch element operably connected to said power supply for activating said alarm.

4. The hand weight of claim 3 wherein said motion detection means operates to supply power to said signal means intermittently resulting in an intermittent light being emitted from said first portion to provide biofeedback to a runner during use.

5. The hand weight of claim 3 wherein said light comprises a light bulb seated within a receptacle connected to said motion detection switch.

6. The hand weight of claim 2 further including first means for removably fastening said first end portion to said hand grip portion to provide access for servicing said light and second means for removably fastening said second end portion to said hand grip portion to provide access for servicing said alarm.

7. The hand weight of claim 1 wherein said light transmitting material comprises a transparent portion and a colored portion.

8. A multi-functional hand weight for a runner, the hand weight comprising:

a body having a first end portion, a second end portion, and a hand grip portion;

light means in said first end portion for emitting light, said light including an electrical circuit;

alarm means in said second end portion for emitting audible sound;

power supply means for providing power to said light means and said alarm means;

switch means for selectively controlling said power supply means to power said light means to emit light and said alarm means to emit sound, said switch means including a first switch element for controlling said light and a second switch element for controlling said alarm; and means for providing biofeedback to a runner, said means comprising a motion detection switch, said motion detection switch including means for opening said electrical circuit in response to said body being in the non-vertical orientation and closing said electrical circuit in response to said body being in the vertical orientation such that power is supplied to said light means intermittently resulting in an intermittent light being emitted from said first end portion.

9. The hand weight of claim 8 further including first means for removably fastening said first end portion to said hand grip portion to provide access for servicing said light means and second means for removably fastening said second end portion to said hand grip portion to provide access for servicing said alarm means and said power supply means.

10. The hand weight of claim 8 wherein said first end portion includes a light transmitting material so as to transmit light emitted from said light means.

* * * * *